US007134853B2

(12) United States Patent
Yamaji et al.

(10) Patent No.: US 7,134,853 B2
(45) Date of Patent: Nov. 14, 2006

(54) SCROLL COMPRESSOR HAVING A FLOW RATE CONTROLLING MEMBER INSERTED INTO A HIGH PRESSURE FLUID INTRODUCING PASSAGEWAY

(75) Inventors: Hiroyuki Yamaji, Sakai (JP); Takashi Uekawa, Sakai (JP); Kazuhiro Furusho, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 134 days.

(21) Appl. No.: 10/492,291

(22) PCT Filed: Jun. 18, 2003

(86) PCT No.: PCT/JP03/07755

§ 371 (c)(1),
(2), (4) Date: Apr. 13, 2004

(87) PCT Pub. No.: WO2004/011808

PCT Pub. Date: Feb. 5, 2004

(65) Prior Publication Data

US 2005/0220652 A1 Oct. 6, 2005

(30) Foreign Application Priority Data

Jul. 29, 2002 (JP) ..... 2002-220005

(51) Int. Cl.
*F04C 18/00* (2006.01)
*F04C 2/00* (2006.01)

(52) U.S. Cl. ..... 418/55.5; 418/55.1; 418/57; 418/94; 418/270

(58) Field of Classification Search ..... 418/55.1–55.5, 418/57, 270, 94, DIG. 1; 184/6.18
See application file for complete search history.

(56) References Cited

U.S. PATENT DOCUMENTS

| | | | | |
|---|---|---|---|---|
| 4,596,520 A * | 6/1986 | Arata et al. | ..... | 418/55.5 |
| 5,217,359 A | 6/1993 | Kawahara et al. | | |
| 6,827,563 B1 * | 12/2004 | Hiwata et al. | ..... | 418/55.5 |

FOREIGN PATENT DOCUMENTS

| | | | | |
|---|---|---|---|---|
| JP | 49-127830 | | 11/1974 | |
| JP | 50-73025 | | 6/1975 | |
| JP | 60-125491 | | 7/1985 | |
| JP | 1-163484 | | 6/1989 | |
| JP | 04334784 | A * | 11/1992 | ..... 418/55.5 |
| JP | 05001677 | A * | 1/1993 | |
| JP | 5-312156 | | 11/1993 | |
| JP | 07027068 | A * | 1/1995 | |
| JP | 8-261177 | | 10/1996 | |
| JP | 9-079422 | | 3/1997 | |
| JP | 2002-168183 | | 6/2002 | |
| JP | 2005240693 | A * | 9/2005 | |
| JP | 2006046188 | A * | 2/2006 | |
| WO | WO 91/06772 | | 5/1991 | |

* cited by examiner

*Primary Examiner*—Theresa Trieu
(74) *Attorney, Agent, or Firm*—Global IP Counselors

(57) ABSTRACT

A flow rate controlling member, provided with a spiral passageway formed on its outer periphery, is inserted into a high pressure fluid introducing passageway formed in an end plate of a movable scroll for the introducing of fluid from a fluid feeding path into a thrust bearing.

9 Claims, 4 Drawing Sheets

SCROLL COMPRESSOR HAVING A FLOW RATE CONTROLLING MEMBER INSERTED INTO A HIGH PRESSURE FLUID INTRODUCING PASSAGEWAY

TECHNICAL FIELD

The present invention relates to scroll type compressors and more specifically to measures for controlling the amount of fluid supplied by a high pressure fluid introducing passageway by which high pressure fluid is introduced to a thrust bearing between end plates of stationary and movable scrolls of a scroll type compressor.

BACKGROUND ART

For example, Japanese Patent Kokai Publication No. (1993)312156 discloses, as an example of compressors which decrease the volume of refrigerant in a refrigeration cycle, a scroll type compressor. A typical scroll type compressor includes a compressing mechanism including within its casing a stationary scroll having a projectingly formed spiral wrap and a movable scroll having a projectingly-formed spiral wrap, wherein the wrap of the movable scroll is intermeshed with the wrap of the stationary scroll. The stationary scroll is firmly secured to the casing. On the other hand, the movable scroll is linked to an eccentric shaft part of a drive shaft.

The movable scroll does not rotate on its axis but executes only an orbital motion relative to the stationary scroll. With the orbital motion of the movable scroll, the volume of a compression chamber formed between the wraps decreases, so that the refrigerant in the compression chamber is compressed.

Incidentally, when refrigerant is compressed in such a scroll type compressor, this causes both a thrust load which is an axial force and a radial load which is a lateral force orthogonal to the thrust load to act on the movable scroll. More specifically, the thrust load acts on a thrust bearing located between an end plate of the stationary scroll and an end plate of the movable scroll and, as a result, the movable scroll is forced to be drawn apart from the stationary scroll. In order to resist the thrust load, there are provided a high pressure gas chamber divisionally formed on the end plate rear surface side of the movable scroll and a high pressure fluid operation space (fluid chamber) to which high pressure fluid is supplied from a high pressure fluid supplying means. A back pressure of the pressure of a high pressure fluid in the fluid chamber and the pressure of a high pressure gas acts as a pressing force that presses the movable scroll in the direction of the stationary scroll. Here, in some cases such a pressing force is small and the vector of a resultant force acting on the movable scroll may pass outside the outer peripheral surface of the thrust bearing. This gives rise to the problem that the movable scroll becomes inclined (overturned) by the action of a so-called upsetting moment and, as a result, there occurs a refrigerant leak, thereby causing a drop in efficiency.

In order to deal with such a problem, an increased back pressure more than a predetermined level is impressed on the movable scroll. Pressing force by the back pressure is determined by the dimensional constraint of a seal ring and the setting of overturn limitation, and however in some cases there may occur an excessive pressing force during the high speed operation. In order to cope with this problem, there has been proposed a construction in which high pressure fluid is introduced to the thrust bearing between the stationary scroll and the movable scroll, with a view to reducing the pressing force.

DISCLOSURE OF INVENTION

Problems that Invention Intends to Solve

Incidentally, originally only extremely small clearance gaps exist in the thrust bearing, which becomes resistance to the flow of high pressure fluid. However, even in the above-proposed structure, there is the possibility that the movable scroll becomes overturned after all during the low differential pressure operation in which the difference in pressure between the refrigerant before compression and the refrigerant after compression is small. If the movable scroll becomes overturned, the thrust bearing looses its flow resistance against fluid. This may cause a large amount of fluid to flow into the compression chamber from the high pressure fluid supplying means. In such a case, the compression chamber is overheated due to the sucking of fluid. As the result of this, the performance of the compressor is degraded drastically. If the amount of flow of the refrigerant increases to a further extent, this produces the problem that the wraps by which the compression chamber is divided will be damaged.

In addition to the above, it is necessary to provide an improved seal effect in the compression chamber in harmony with degradation in performance due to heating by suction, by adjusting the amount of fluid flowing into the thrust bearing from the high pressure fluid supplying means.

To this end, it is thought that a restriction mechanism such as an orifice or a dummy column such as a capillary is provided in the high pressure fluid introducing passageway so that the amount of flow of the passing fluid is limited constantly.

However, for the case of providing orifices, it is impossible to obtain a satisfactory restriction effect unless a plurality of orifices having a diameter for example not more than 0.6 mm are provided serially in the high pressure fluid introducing passageway. Even in such arrangement, if the fluid gets mixed with contaminants, this causes orifices to become readily clogged.

On the other hand, for the case of providing a capillary, the length of a capillary itself must be extended to obtain a satisfactory restriction effect. Space for securing such a length is required, and the cost of machining thereof is high. Accordingly, the possibility of putting this case into practical use is thin.

The present invention was made in the light of providing solutions to the above-described problems. Accordingly, an object of the present invention is to prevent degradation in compressor performance, and to achieve stable feeding of fluid to the thrust bearing by proposing an improved construction capable of preventing the high pressure fluid introducing passageway from becoming clogged, and capable of preventing, even when the movable scroll is overturned during the low differential pressure operation, large amounts of fluid from flowing into the compression chamber.

Problem-Solving Means

In order to achieve the above-stated objection, in a first invention a compressor is disclosed which comprises a stationary scroll (24) and a movable scroll (26) which is intermeshed with the stationary scroll (24). In the compressor of the first invention, the movable scroll (26) is pressed toward the stationary scroll (24). The compressor further comprises a high pressure fluid introducing passageway (60) by which fluid from high pressure fluid supplying means (55) is discharged to a thrust bearing (28) between an end plate (24*a*) of the stationary scroll (24) and an end plate (26*a*) of the movable scroll (26). Furthermore, a flow rate controlling member (70), provided with a spiral passageway (60*a*) formed on the outer periphery thereof, is inserted into the high pressure fluid introducing passageway (60).

In the construction of the first invention, the flow rate controlling member (70) is inserted into the high pressure fluid introducing passageway (60), thereby allowing formation of the spiral passageway (60*a*) even in a small space, i.e., in the high pressure fluid introducing passageway (60). By virtue of the spiral passageway (60*a*), it becomes possible to maintain the passageway length sufficiently long. Because of this, it is possible to obtain a satisfactory restriction effect even when the cross-sectional area of the passageway is made greater than that of conventional orifices. Accordingly, the passageway is free from becoming clogged even when the high pressure fluid gets mixed with contaminants.

Furthermore, even when, during the low differential pressure operation in which the difference in pressure between the refrigerant before compression and the refrigerant after compression is small, the movable scroll becomes overturned causing the thrust bearing (28) to loose its resistance to the flow of fluid, the spiral passageway (60*a*) of the flow rate controlling member (70) provides a satisfactory restriction effect. Consequently, large amounts of fluid will not flow into the compression chamber (40) from the high pressure fluid supplying means (55). Additionally, the use of a flow rate controlling member (70) provided with a spiral passageway (60*a*) having a different pitch makes it possible to deal with changes in the flow resistance specification. As the result of this, the movable scroll (26) is pushed back in the direction in which the movable scroll (26) is drawn apart from the stationary scroll (24) by an adequate force reducing mechanical loss in the thrust bearing (28).

Accordingly, the compressor (1) is prevented from undergoing a significant drop in its performance due to overheating taking place when fluid is drawn into the compression chamber (40). Besides, the wraps (24*b*, 26*b*) constituting the compression chamber (40) are prevented from being damaged.

In a second invention, the high pressure fluid introducing passageway (60) is formed either in the end plate (24*a*) of the stationary scroll (24) or in the end plate (26*a*) of the movable scroll (26). An insertion aperture (64) in communication with the high pressure fluid introducing passageway (60) is opened in an outer peripheral surface of the end plate (24*a*, 26*a*). The flow rate controlling member (70) is inserted, through the insertion aperture (64), into the high pressure fluid introducing passageway (60) and is fixed there in a sealed manner.

In the construction of the second invention, the flow rate controlling member (70) is inserted, through the insertion aperture (64) opening in the outer peripheral surface of the end plate (24*a*, 26*a*), into the high pressure fluid introducing passageway (60) and is fixed there. This provides a simplified construction and therefore reduces the cost. Additionally, the flow rate controlling member (70) is inserted, in a sealed manner, through the insertion aperture (64), thereby preventing high pressure fluid from leaking to outside the end plate (24*a*, 26*a*) of the stationary scroll (24) or the movable scroll (26). Accordingly, a desirable layout construction for the flow rate controlling member (70) is obtained concretely and easily.

In a third invention, a greater diameter part (74) having a diameter greater than that of the insertion aperture (64) is formed at a base end of the flow rate controlling member (70), and the flow rate controlling member (70) is sealed by a surface seal (80) interposed between the greater diameter part (74) of the flow rate controlling member (70) and the outer peripheral surface of the end plate (24*a*, 26*a*) around the opening peripheral edge of the insertion aperture (64). Additionally, in a fourth invention the flow rate controlling member (70) is sealed by a seal material (81) mounted on a base end of the flow rate controlling member (70). Furthermore, in a fifth invention the flow rate controlling member (70) is sealed by a PT screw mounted on a base end of the flow rate controlling member (70) so as to be engaged threadedly to the insertion aperture (64). In accordance with the construction of each of the forgoing inventions, desirable concrete examples of the seal construction are obtained without any difficulty.

Effects of Invention

As has been described above, in accordance with the compressor of the first invention the flow rate controlling member provided with the spiral passageway formed in its outer peripheral surface is inserted into the high pressure fluid introducing passageway for the supplying of fluid from the high pressure fluid supplying means to the thrust bearing between the end plates of the stationary and movable scrolls, whereby even when the high pressure fluid gets mixed with contaminants the passageway is free from becoming clogged. Furthermore, the compressor is prevented from undergoing a significant drop in its performance due to overheating taking place when fluid is drawn into the compression chamber. Besides, the wraps constituting the compression chamber are prevented from being damaged.

In accordance with the second invention, the flow rate controlling member is inserted, through the insertion aperture in the end plate outer peripheral surface of the stationary or movable scroll in which the high pressure fluid introducing passageway is formed, into the high pressure fluid introducing passageway and is fixed there while being sealed against the insertion aperture, whereby a desirable layout construction for the flow rate controlling member is obtained concretely and easily.

In accordance with the third invention, it is arranged such that the flow rate controlling member is sealed using a surface seal interposed between the greater diameter part at the base end of the flow rate controlling member and the end plate outer peripheral surface around the opening peripheral edge of the insertion aperture. In the fourth invention, it is arranged such that the flow rate controlling member is sealed using a seal material mounted on the base end of the flow rate controlling member. Finally, in the fifth invention it is arranged such that the flow rate controlling member is sealed using a PT screw mounted on the base end of the flow rate controlling member. With these inventions, desirable seal constructions for the flow rate controlling member are obtained.

BEST MODE FOR CARRYING OUT INVENTION

Embodiment 1

Figure 1:
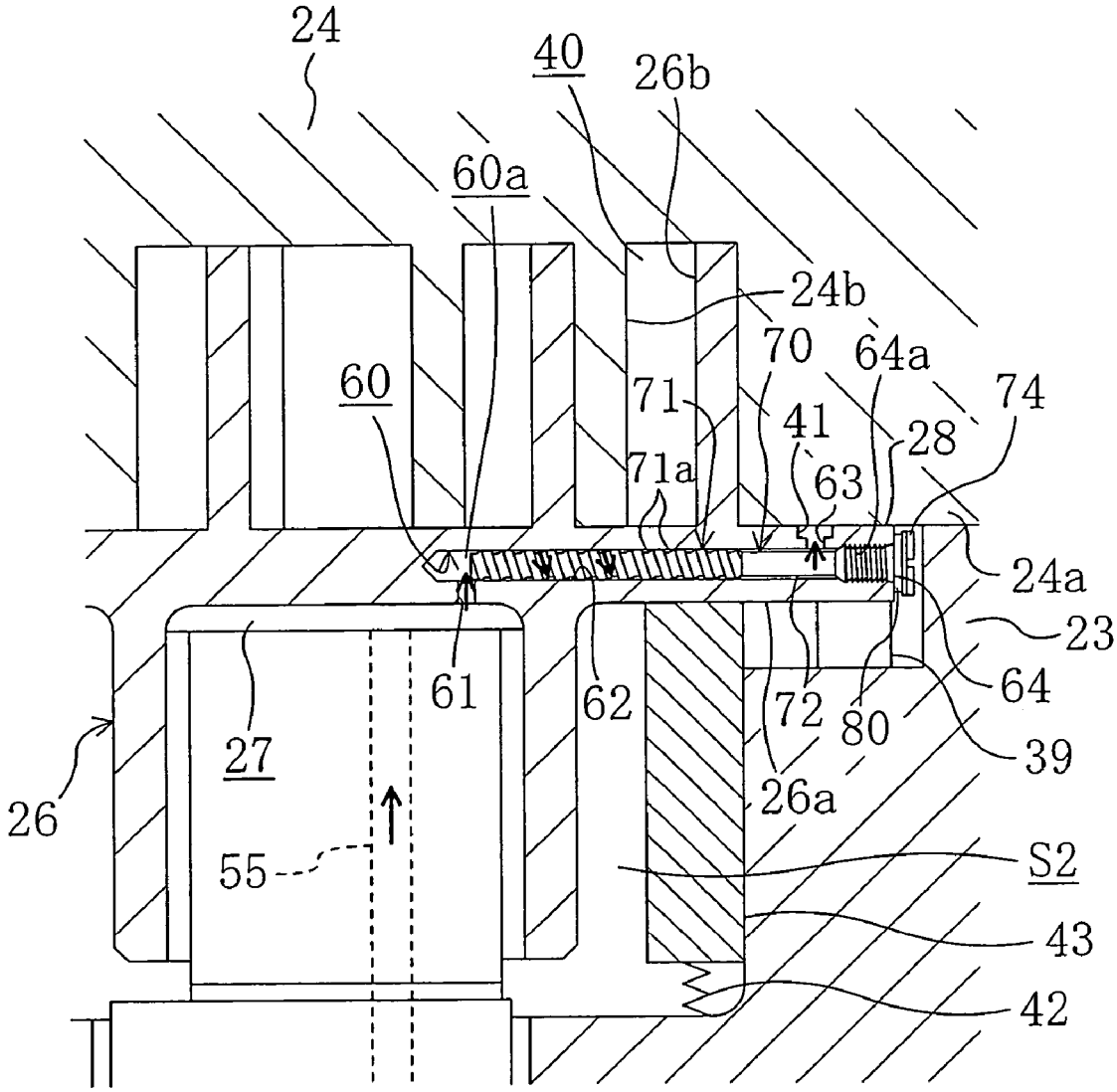
FIG. 1 is a cross-sectional view showing in an enlarged manner a peripheral section of a high pressure fluid introducing passageway.

Hereinafter, a first embodiment of the present invention will now be described with reference to the drawing figures.

Figure 3:
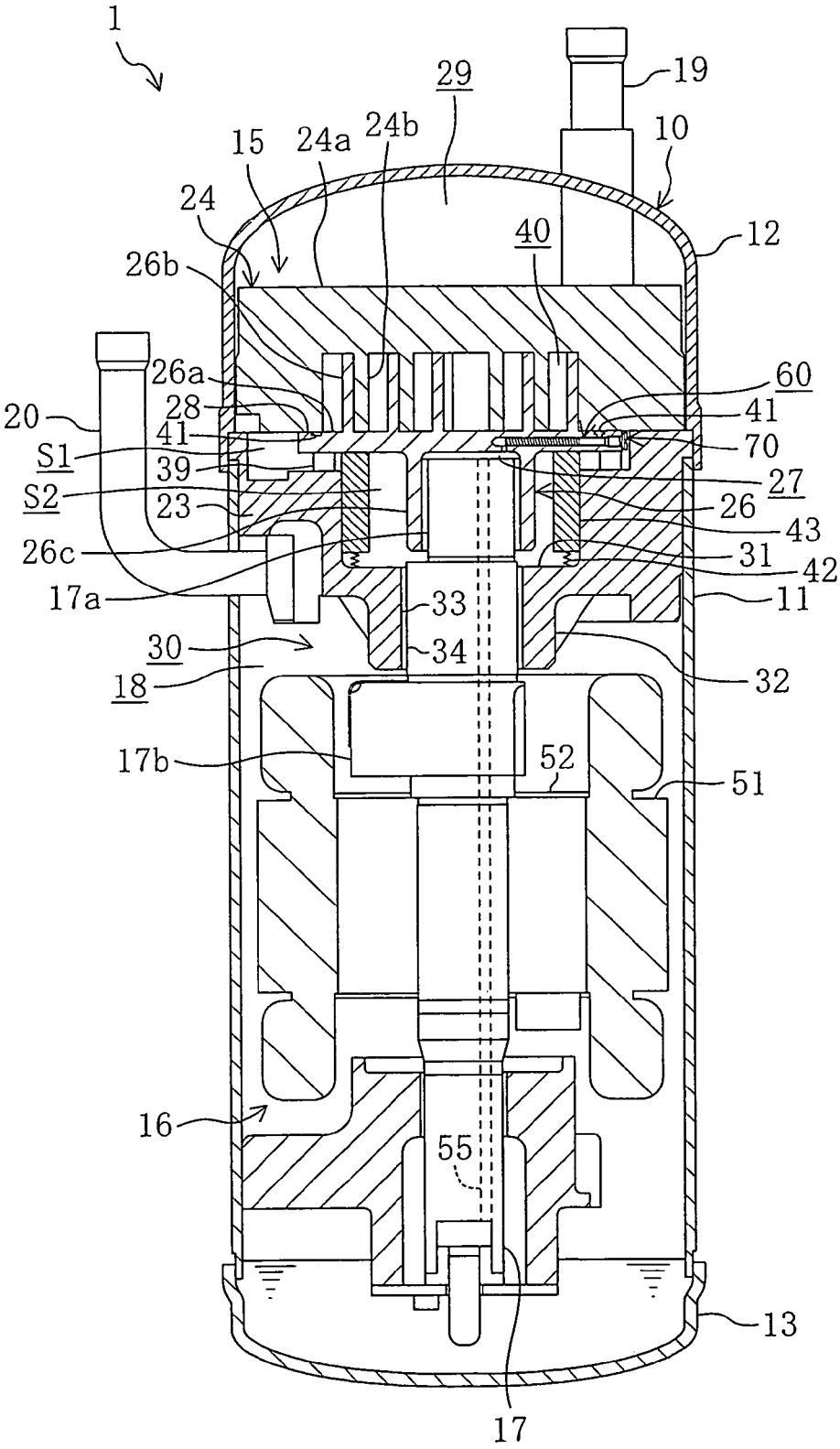
FIG. 3 is a front cross-sectional view of a compressor according to a first embodiment of the present invention.

Referring to FIG. 3, there is shown a compressor (1) according to the first embodiment. The compressor (1) is connected to a refrigerant circuit (not shown) in which refrigerant is circulated so that a refrigeration cycle operation action is carried out and decreases the volume of refrigerant.

The compressor (1) has a hermetically-closed dome type casing (10) shaped like an oblong cylinder. The casing (10) is constructed in the form of a pressure vessel comprising: a casing main body (11) which is a cylindrical trunk part having a vertically-extending axis line; an upper wall part (12) shaped like a saucer having a convex surface projecting upward and hermetically welded to an upper end of the casing main body (11) so that the upper wall part (12) and the casing main body (11) are joined together integrally; and a lower wall part (13) shaped like a saucer having a convex surface projecting downward and hermetically welded to a lower end of the casing main body (11) so that the lower wall part (13) and the casing main body (11) are joined together integrally. The inside of the casing (10) is hollow.

Housed in the casing (10) are a scroll compressing mechanism (15) which decreases the volume of refrigerant and a drive motor (16) disposed below the scroll compressing mechanism (15). The scroll compressing mechanism (15) and the drive motor (16) are connected together by a drive shaft (17) which is so disposed as to extend vertically in the casing (10). And, defined between the scroll compressing mechanism (15) and the drive motor (16) is a clearance space (18).

The scroll compressing mechanism (15) comprises: a housing (23) which is a bottomed, substantially cylindrical housing member with an opening at its upper side end; a stationary scroll (24) mounted closely on an upper surface of the housing (23); and a movable scroll (26) so mounted between the stationary scroll (24) and the housing (23) as to be intermeshed with the stationary scroll (24). Over its full outer peripheral surface, the housing (23) is press-fitted into the casing main body (11) and is fixed there. In other words, the casing main body (11) and the housing (23) are hermetically joined together over the full circumference. And, in the first embodiment the interior space of the casing (10) is divided into a high pressure space (30) underlying the housing (23) and a low pressure space (29) overlying the housing (23), in other words the compressor (1) is constructed into a so-called high-low dome type compressor.

Formed in the housing (23) are a housing recessed part (31) which is a dent formed centrally in an upper surface of the housing (23) and a radial bearing part (32) extending downward from a central part of a lower surface of the housing (23). And, a radial bearing aperture (33) passing through between a lower end surface of the radial bearing part (32) and a bottom surface of the housing recessed part (31) is formed in the housing (23). An upper end of the drive shaft (17) is supportedly rotatably engaged into the radial bearing aperture (33) through a radial bearing (34).

A suction pipe (19) through which refrigerant in the refrigerant circuit is directed to the scroll compressing mechanism (15) passes through the upper wall part (12) and is hermetically fixed thereto. Additionally, a discharge pipe (20) through which refrigerant in the casing (10) is discharged to outside the casing (10) passes through the casing main body (11) and is hermetically fixed thereto. The suction pipe (19) extends vertically in the low pressure space (29), wherein its inner end passes through the stationary scroll (24) of the scroll compressing mechanism (15) and comes into communication with a compression chamber (40) which will be described later. By virtue of the suction pipe (19), refrigerant is drawn into the compression chamber (40).

The drive motor (16) is formed by a direct current motor comprising an annular stator (51) secured firmly to an internal wall surface of the casing (10) and a rotor (52) rotatably constructed interior to the stator (51). The movable scroll (26) of the scroll compressing mechanism (15) is drivingly linked to the rotor (52) via the drive shaft (17).

The pressure level of a lower space situated below the drive motor (16) is held high, and fluid is stored at the inner bottom of the lower wall part (13) corresponding to its lower end. Formed in the drive shaft (17) is a fluid feeding path (55) serving as part of a high pressure fluid supplying means. The fluid feeding path (55) is in fluid communication with a fluid chamber (27) of the rear surface of the movable scroll (26) which will be described later, wherein the fluid surface is pressurized by the pressure of gas in the lower space for generation of high pressure fluid. The high pressure fluid thus generated is drawn up into the fluid chamber (27) by making utilization of a difference in pressure between itself and a first space (S1) which will be described later. The fluid drawn up by such a differential pressure is supplied, through the fluid feeding path (55), to respective sliding parts of the scroll compressing mechanism (15) which will be described later as well as to the fluid chamber (27).

The stationary scroll (24) is made up of an end plate (24*a*) and a scroll (involute) wrap (24*b*) formed in a lower surface of the end plate (24*a*). On the other hand, the movable scroll (26) is made up of an end plate (26*a*) and a scroll (involute) wrap (26*b*) formed in an upper surface of the end plate (26*a*). And, the wrap (26*b*) of the movable scroll (26) is intermeshed with the wrap (24*b*) of the stationary scroll (24), whereby between the stationary scroll (24) and the movable scroll (26) there is formed the compression chamber (40) between contacting parts of the wraps (24*b*, 26*b*).

The movable scroll (26) is supported on the housing (23) through an Oldham ring (39), and a boss part (26*c*) shaped like a bottomed cylinder is provided, in a projecting manner, centrally in the lower surface of the end plate (26*a*). On the other hand, an eccentric shaft part (17*a*) is provided at the upper end of the drive shaft (17). The eccentric shaft part (17*a*) is rotatably engaged into the boss part (26*c*) of the movable scroll (26). Furthermore, a counterweight part (17*b*), for maintaining a dynamic balance with the movable scroll (26), the eccentric shaft part (17*a*), et cetera, is provided in the drive shaft (17) under the radial bearing part (32) of the housing (23). The drive shaft (17) rotates while maintaining a weight balance by the counterweight part (17*b*), and the movable scroll (26) does not rotate on its axis but executes an orbital motion in the housing (23). And, with the orbital motion of the movable scroll (26), the volume between the wraps (24*b*, 26*b*) is contracted toward the center, and in the compression chamber (40) the volume of a refrigerant drawn in from the suction pipe (19) is decreased.

Additionally, formed in the scroll compressing mechanism (15) is a gas passageway (not shown) that extends from the stationary scroll (24) to the housing (23) so that the compression chamber (40) and the clearance space (18) are connected together. The refrigerant compressed in the compression chamber (40) flows out to the clearance space (18) through the gas passageway.

On the side of the rear surface (lower surface) of the end plate (26*a*) of the movable scroll (26), the fluid chamber (27) is divisionally defined between the boss part (26*c*) of the movable scroll (26) and the eccentric shaft part (17*a*) of the drive shaft (17). The fluid chamber (27) is constructed such that it is fed high pressure fluid from the fluid feeding path (55).

Mounted in the housing recessed part (31) of the housing (23) is a seal member (43) which is brought into press contact with the rear surface (lower surface) of the end plate (26*a*) of the movable scroll (26) by a spring (42). The housing recessed part (31) is divided, by the seal member (43), into a first space (S1) on the outside-diameter side and a second space (S2) on the inside-diameter side of the seal member (43).

The pressure level of the second space (S2) is held high by introduction of a high pressure gas thereinto via a passageway (not shown). A back pressure of the pressure of the high pressure gas and the pressure of the high pressure fluid in the fluid chamber (27) becomes an axial pressing force by which the movable scroll (26) is pressed in the direction of the stationary scroll (24). The second space (S2) constitutes a high pressure space which impresses a pressing force on the rear surface (lower surface) of the end plate (26*a*) of the movable scroll (26). On the other hand, the first space (S1) constitutes a low pressure space.

Additionally, the end plate (26*a*) of the movable scroll (26) is allowed to establish sliding contact with the end plate (24*a*) of the stationary scroll (24) with their outer peripheral surfaces opposing each other. These sliding surfaces are constructed in a thrust bearing (28).

As also shown in FIG. 1, in the upper surface of the end plate (26*a*) of the movable scroll (26) an annular fluid groove (41) is formed in a sliding surface forming a thrust bearing (28) on the side of the wrap's (26*b*) outer periphery. Further, a high pressure fluid introducing passageway (60) is formed in the end plate (26*a*). The high pressure fluid introducing passageway (60) extends radially in the end plate (26*a*), wherein one of its ends is in communication with the fluid chamber (27) and the other end thereof opens to the fluid groove (41) of the sliding surface of the thrust bearing (28). Fluid is introduced to the fluid groove (41) from the fluid feeding path (55) via the high pressure fluid introducing passageway (60). Then, the fluid is discharged to the thrust bearing (28) from the fluid groove (41), whereby the movable scroll (26) is pushed back in the direction of the stationary scroll (24) by a force smaller than a pressing force by a back pressure of the pressure of a high pressure gas in the second space (S2) and the pressure of a high pressure fluid of the fluid chamber (27). An axial force acting on the thrust bearing (28) is suppressed by such a pushing-back force, thereby reducing mechanical loss in the thrust bearing (28).

As shown, in a detailed, enlarged manner, in FIG. 1, the high pressure fluid introducing passageway (60) comprises: a shaft insertion part (62) extending radially in the end plate (26*a*); an inlet part (61) one end of which is continuous to the end plate central side of the shaft insertion part (62) and the other end of which opens to the end plate rear surface side and communicates with the fluid chamber (27) at the rear of the movable scroll (26); and an outlet part (63) one end of which is continuous to the end plate outer peripheral side of the shaft insertion part (62) and the other end of which opens to the fluid groove (41) (the sliding surface of the thrust bearing (28)).

And, a flow rate controlling member (70) with a spiral passageway (60*a*) formed on its outer periphery is inserted into the high pressure fluid introducing passageway (60). In other words, an insertion aperture (64) is formed continuously in the end plate (26*a*) so that the shaft insertion part (62) of the high pressure fluid introducing passageway (60) extends on the end plate outer peripheral surface side. One end of the insertion aperture (64) is in communication with the shaft insertion part (62) and the other end thereof opens to the outer peripheral surface of the end plate (26*a*). A female thread (64*a*) is formed in the vicinity of the opening end of the insertion aperture's (64) inner peripheral surface, and the flow rate controlling member (70) is inserted, through the insertion aperture (64), into the high pressure fluid introducing passageway (60).

Figure 2:
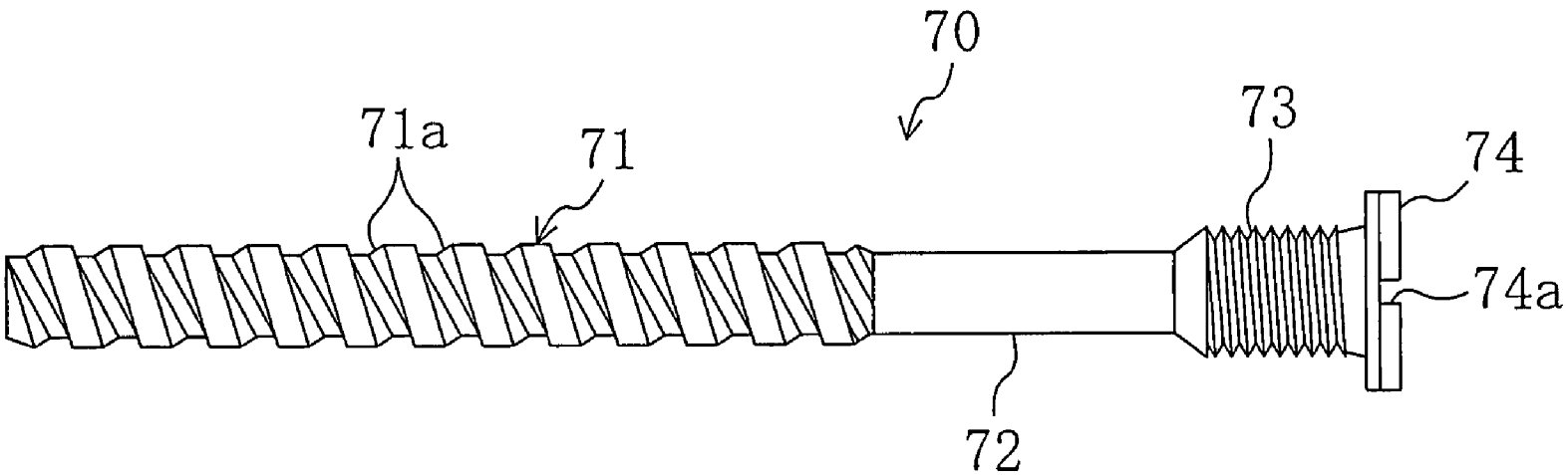
FIG. 2 is a front view showing the entire structure of a flow rate controlling member.

As can be seen from FIG. 2, the flow rate controlling member (70) comprises: a leading-end side main body (71) positioned in the shaft insertion part (62) of the high pressure fluid introducing passageway (60); a smaller diameter part (72) formed consecutively to the base end of the main body (71) and arranged correspondingly to the outlet part (63); a screw part (73) formed consecutively to the base end of the smaller diameter part (72) and engaged threadedly to the female thread (64*a*) of the insertion aperture (64); and a greater diameter part (74) continuous to the base end of the screw part (73), positioned exterior to the end plate (26*a*), and having a diameter greater than that of the insertion aperture (64). A spiral groove (71*a*), extending continuously spirally and having a trapezoidal cross section, is formed in an outer peripheral surface of the main body (71). Additionally, the greater diameter part (74) is shaped like a disc, and a tool catching part (74*a*) for the catching of a tool is formed in its outer peripheral surface.

And, as shown in FIG. 1, after being inserted into the high pressure fluid introducing passageway (60) from the insertion aperture (64), the flow rate controlling member (70) is rotated by a tool engaged to the tool catching part (74*a*) so that the screw part (73) is threaded into the female thread (64*a*) of the insertion aperture (64), whereby the flow rate controlling member (70) is fixedly fastened to the end plate (26*a*). A surface seal (80) having a central aperture for insertion of the flow rate controlling member (70) therethrough is interposed between the rear surface of the greater diameter part (74) and the end plate's (26*a*) outer peripheral surface around the opening edge of the insertion aperture (64). By virtue of the surface seal (80), the flow rate controlling member (70) is liquid-tightly sealed against the opening of the insertion aperture (64).

Next, the operating action of the high-low dome type compressor (1) will now be described below.

When the drive motor (16) is activated, the rotor (52) starts rotating relative to the stator (51), whereby the drive shaft (17) is rotated. With the rotation of the drive shaft (17), the movable scroll (26) of the scroll compressing mechanism (15) orbits relative to the stationary scroll (24) without rotating on its axis. As the result of this, low pressure refrigerant is drawn into the compression chamber (40) from the peripheral edge side of the compression chamber (40) via the suction pipe (19). With the variation in volume of the compression chamber (40), the refrigerant is compressed. The refrigerant thus compressed to a high pressure is discharged from the compression chamber (40). Thereafter, the refrigerant passes through the gas passageway and then flows into the clearance space (18).

The refrigerant in the clearance space (18) flows into the discharge pipe (20) and is discharged to outside the casing (10). The refrigerant, discharged to outside the casing (10), circulates in the refrigerant circuit. Thereafter, the refrigerant is again drawn into the compressor (1) via the suction pipe (19) for compression. Such a refrigerant circulation cycle is repeatedly carried out.

The flow of fluid will be described. Fluid, stored at the inner bottom of the lower wall part (13) of the casing (10), is pressurized by the pressure of gas in the lower space. The fluid compressed to a high pressure is supplied, through the fluid feeding path (55), to respective sliding parts of the scroll compressing mechanism (15) as well as to the fluid chamber (27) by a difference in pressure between itself and the first space (S1) which is a low pressure space.

During that period, the movable scroll (26) is pressed in the direction of the stationary scroll (24) by a given pressing force by a back pressure of the pressure of the high pressure gas introduced into the second space (S2) and the pressure of the high pressure fluid in the fluid chamber (27). Such a pressing force becomes a force acting against a thrust load which is an axial force generated in the movable scroll (26) by fluid compression in the compression chamber (40).

Furthermore, a part of the fluid in the fluid chamber (27) is further supplied, through the high pressure fluid introducing passageway (60) in the end plate (26*a*) of the movable scroll (26), to the fluid groove (41) opening to the sliding contact surface of the thrust bearing (28). The fluid is emitted from the fluid groove (41), so that the movable scroll (26) is pushed back toward the stationary scroll (24) by a force smaller than a pressing force by a back pressure of the pressure of the high pressure gas in the second space (S2) and the pressure of the high pressure fluid in the fluid chamber (27). This prevents axial force acting on the thrust bearing (28) from becoming excessive, thereby achieving a reduction in mechanical loss occurring in the thrust bearing (28).

Since the flow rate controlling member (70) is inserted into the high pressure fluid introducing passageway (60), this provides the following functions. The spiral passageway (60*a*) is defined between the spiral groove (71*a*) formed in the outer peripheral surface of the flow rate controlling member (70) and the inner peripheral surface of the shaft insertion part (62) of the high pressure fluid introducing passageway (60). The spiral passageway (60*a*) is small in cross-sectional area, in other words the length of the spiral passageway (60*a*) is maintained sufficiently long even within the high pressure fluid introducing passageway (60) which is not spacious. Because of this, even when the cross-sectional area of the spiral passageway (60*a*) is made greater than that of conventional orifices, it is possible to obtain a sufficient restriction effect. Additionally, even when high pressure fluid gets mixed with contaminants, passageway clogging will not occur.

Furthermore, the spiral passageway (60*a*) of the flow rate controlling member (70) provides a sufficient restriction effect. Accordingly, even when there occurs such a state that the thrust bearing (28) loses it resistance to the flow of fluid when the movable scroll (26) is overturned during the low differential pressure operation in which the difference in pressure between the refrigerant before compression by the scroll compressing mechanism (15) and the refrigerant after compression by the scroll compressing mechanism (15), large amounts of fluid will not flow into the compression chamber (40) from the fluid chamber (27).

Accordingly, the compressor (1) is prevented from undergoing a significant drop in its performance due to overheating taking place when fluid is drawn into the compression chamber (40). Besides, the wraps (24*b*, 26*b*) constituting the compression chamber (40) are prevented from being damaged.

Further, since the flow rate controlling member (70) is fastened by being inserted into the high pressure fluid introducing passageway (60) from the insertion aperture (64) which opens in the outer peripheral surface of the end plate (24*a*, 26*a*), this provides an inexpensive fluid flow rate controlling structure.

Furthermore, since the greater diameter part (74) is provided at the base end of the flow rate controlling member (70) and the flow rate controlling member (70) is sealed by the surface seal (80) interposed between the greater diameter part (74) and the outer peripheral surface of the end plate (24*a*, 26*a*) around the opening peripheral edge of the insertion aperture (64), this prevents the leakage of high pressure fluid.

Further, it is possible to easily cope with a change in the specification of flow resistance by making use of a flow rate controlling member (70) provided with a spiral passageway (60*a*) having a different pitch. As the result of this, the movable scroll (26) is pushed back in the direction in which the movable scroll (26) is drawn away from the stationary scroll (24) by an adequate force reducing mechanical loss in the thrust bearing (28).

Embodiment 2

Figure 4:
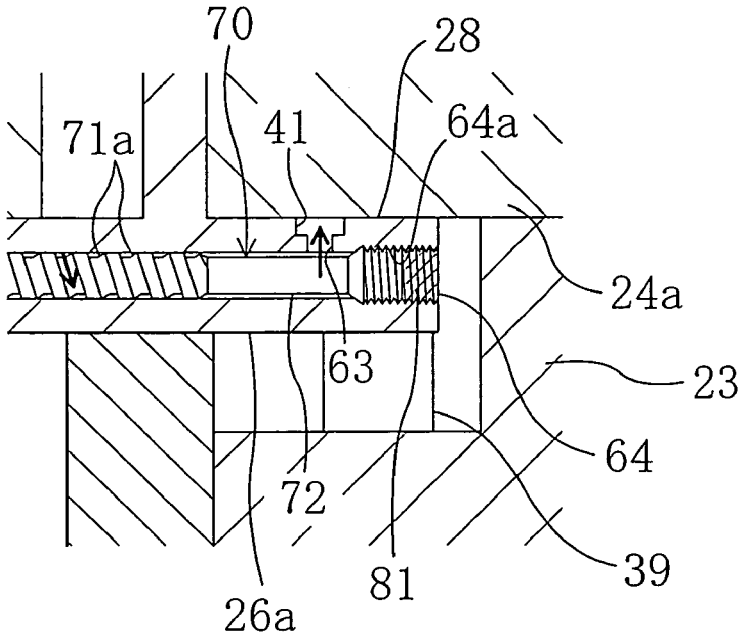
FIG. 4 is an enlarged cross-sectional view showing a principal section of a second embodiment of the present invention.

Referring to FIG. 4, there is shown a second embodiment of the present invention. The second embodiment has a modified seal structure for the insertion aperture (64) of the flow rate controlling member (70). In each of the following embodiments, the same parts as those shown in FIGS. 1–3 have been assigned the same reference numerals and detailed description of these parts is omitted accordingly.

To sum up, in the present embodiment a seal material (81) composed of, for example, an adhesive agent is wound around the outer peripheral surface of the screw part (73) of the flow rate controlling member (70) so as to be engaged threadedly to the female thread (64*a*) of the insertion aperture (64), whereby sealing between the outer peripheral surface of the flow rate controlling member (70) and the inner peripheral surface of the insertion aperture (64) is provided. In the figure, the seal material (81) is indicated by hatching for the sake of simplicity. Other constructions are the same as the first embodiment.

Accordingly, in the present embodiment the leakage of high pressure fluid to outside the end plate (26*a*) of the movable scroll (26) is prevented from occurring, thereby providing another preferable operative example of the seal construction, as in the first embodiment.

Embodiment 3

Figure 5:
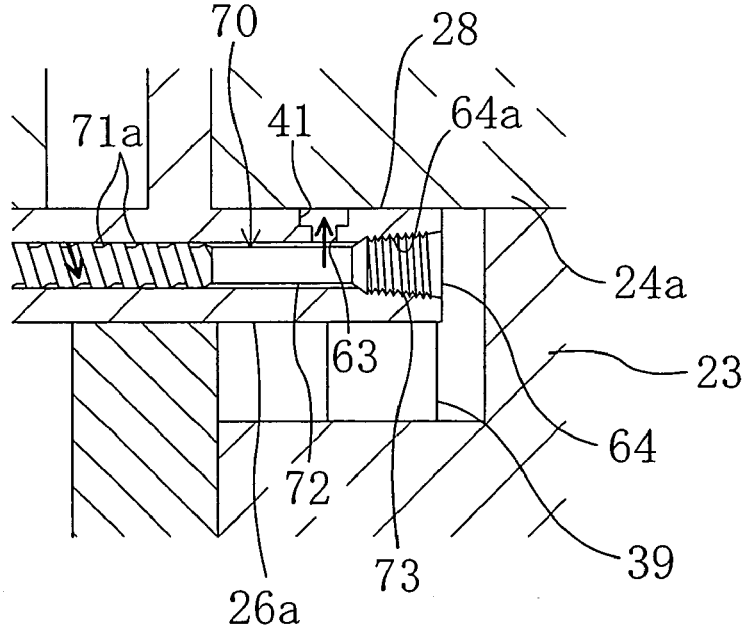
FIG. 5 is an equivalent view to FIG. 4 according to a third embodiment of the present invention.

Referring to FIG. 5, there is shown a third embodiment of the present invention. The third embodiment is an embodiment in which the screw part (73) of the flow rate controlling member (70) is a PT screw which is a tapered screw used for pipes. The PT screw is engaged threadedly to the insertion aperture (64) and sealed. The PT screw has a screw part which is a tapered surface, thereby providing high tight properties. Therefore, the leakage of high pressure fluid to outside the end plate (26*a*) of the movable scroll (26) is prevented from occurring.

Other Embodiments

Each of the foregoing embodiments is directed to the high-low pressure dome type compressor (1) in which the interior space of the casing (10) is divided into the high pressure space (30) defined below the housing (23) and the low pressure space (29) defined above the housing (23). However, it is possible for a high pressure dome type compressor, in which refrigerant once compressed in the compression chamber (40) is discharged above the housing (23), to provide the same effects that the present invention does.

Furthermore, in each of the foregoing embodiments the high pressure fluid supplying means (55) makes utilization of a differential pressure for the supplying of fluid. Alternatively, the use of a centrifugal pump, a positive displacement pump, or the like also provides the same effects that the present invention does.

Further, in each of the foregoing embodiments the fluid groove (41) is formed in the end plate (26*a*) of the movable scroll (26). Alternatively, the fluid groove may be formed in the end plate of the stationary scroll.

Furthermore, in each of the foregoing embodiments the high pressure fluid introducing passageway (60) communicating with the thrust bearing (28) from the fluid chamber (27) is formed in the end plate (26*a*) of the movable scroll (26). The high pressure fluid introducing passageway (60) may employ the following structure. In the end plate (24*a*) of the stationary scroll (24) or in the end plate (26*a*) of the movable scroll (26), a fluid groove is formed in a sliding surface of the thrust bearing (28). And, the high pressure fluid introducing passageway extends through the inside of the housing (23) from the radial bearing part (32) to the upper surface of the housing (23) in abutment with the outside of the thrust bearing (28) in the lower surface of the end plate (24*a*) of the stationary scroll (24). Furthermore, the high pressure fluid introducing passageway extends through the inside of the end plate (24*a*) of the stationary scroll (24) from the lower surface in abutment with the upper surface of the housing (23) to the fluid groove opening to the sliding contact surface of the thrust bearing (28).

INDUSTRIAL APPLICABILITY

As has been described above, the compressor of the present invention proves useful as a refrigeration cycle compressor. The compressor of the present invention is especially suitable when used as a compressor for the introducing of high pressure fluid to a thrust bearing between a stationary scroll end plate and a movable scroll end plate.

What is claimed is:

1. A compressor comprising:

a stationary scroll and a movable scroll which is intermeshed with said stationary scroll, said movable scroll being configured to be pressed toward said stationary scroll;

a high pressure fluid introducing passageway provided with an outlet part and configured to discharge fluid from a high pressure fluid supplying part to a thrust bearing between an end plate of said stationary scroll and an end plate of said movable scroll; and a flow rate controlling member provided with a main unit disposed inside said high pressure fluid introducing passageway and a small diameter part connected to said main unit and arranged to correspond to said outlet part, said main unit having a spiral passageway formed in an outer periphery thereof, said flow rate controlling member being inserted into said high pressure fluid introducing passageway.

2. The compressor of claim 1, wherein said high pressure fluid introducing passageway is formed in one of said end plate of said stationary scroll and said end plate of said movable scroll, an insertion aperture in communication with said high pressure fluid introducing passageway is opened in an outer peripheral surface of said one of said end plate of said stationary scroll and said end plate of said movable scroll, and said flow rate controlling member is inserted through said insertion aperture into said high pressure fluid introducing passageway and is fixed therein in a sealed manner.

3. The compressor of claim 2, wherein a greater diameter part having a diameter greater than that of said insertion aperture is formed at a base end of said flow rate controlling member, and said flow rate controlling member is sealed by a surface seal interposed between said greater diameter part of said flow rate controlling member and said outer peripheral surface around an opening peripheral edge of said insertion aperture.

4. The compressor of claim 2, wherein said flow rate controlling member is sealed by a seal material mounted on a base end of said flow rate controlling member.

5. The compressor of claim 2, wherein said flow rate controlling member is sealed by a PT screw mounted on a base end of said flow rate controlling member so as to be engaged threadedly to said insertion aperture.

6. A compressor comprising:

a stationary scroll and a movable scroll which is intermeshed with said stationary scroll, said movable scroll being configured to be pressed toward said stationary scroll;

a high pressure fluid introducing passageway provided with an outlet part and configured to discharge fluid from a high pressure fluid supplying part to a thrust bearing between an end plate of said stationary scroll and an end plate of said movable scroll; and a flow rate controlling member, provided with a spiral passageway formed on an outer periphery thereof, that is inserted into said high pressure fluid introducing passageway, said high pressure fluid introducing passageway being formed in one of said end plate of said stationary scroll and said end plate of said movable scroll, an insertion aperture in communication with said high pressure fluid introducing passageway being opened in an outer peripheral surface of said one of said end plate of said stationary scroll and said end plate of said movable scroll, and said flow rate controlling member being inserted through said insertion aperture into said high pressure fluid introducing passageway and fixed to said one of said end plate of said stationary scroll and said end plate of said movable scroll in such a manner that a base end of said flow rate controlling member is sealed with respect to said insertion aperture, said base end being located on a side of said flow rate controlling member that corresponds to said insertion aperture.

7. The compressor of claim 6, wherein a greater diameter part having a diameter greater than that of said insertion aperture is formed at said base end of said flow rate controlling member, and said flow rate controlling member is sealed by a surface seal interposed between said greater diameter part of said flow rate controlling member and a portion of the surface of said end plate surrounding said insertion aperture.

8. The compressor of claim 6, wherein said flow rate controlling member is sealed by a seal material mounted on said base end of said flow rate controlling member.

9. The compressor of claim 6, wherein said flow rate controlling member is sealed by a PT screw mounted on said base end of said flow rate controlling member so as to be engaged threadedly to said insertion aperture.

* * * * *